US010028354B2

(12) United States Patent
Barker et al.

(10) Patent No.: US 10,028,354 B2
(45) Date of Patent: Jul. 17, 2018

(54) LIGHTING STATUS SIGNALING SYSTEM AND METHOD

(71) Applicant: SPX Corporation, Charlotte, NC (US)

(72) Inventors: Casey W. Barker, Hendersonville, TN (US); Russell Bruner, Hendersonville, TN (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 15/047,992

(22) Filed: Feb. 19, 2016

(65) Prior Publication Data

US 2017/0245331 A1 Aug. 24, 2017

(51) Int. Cl.

| | |
|---|---|
| ***H05B 37/03*** | (2006.01) |
| ***H05B 33/08*** | (2006.01) |
| ***F21V 25/02*** | (2006.01) |
| ***F21V 23/00*** | (2015.01) |
| *F21W 111/06* | (2006.01) |
| *F21Y 115/10* | (2016.01) |

(52) U.S. Cl.

CPC ..... *H05B 33/089* (2013.01); *F21V 23/003* (2013.01); *F21V 25/02* (2013.01); *H05B 33/0803* (2013.01); *H05B 37/03* (2013.01); *F21W 2111/06* (2013.01); *F21Y 2115/10* (2016.08)

(58) Field of Classification Search

CPC ..... F21W 2131/10; F21W 2131/1005; F21W 2131/101; F21W 2131/103; F21W 2131/105; F21W 2131/107; F21W 2111/00; B64F 1/18; B64F 1/20; H04B 3/542; F21S 8/003

USPC ..... 340/983, 3.42–3.44, 853.2, 855.4, 538; 315/132, 291, 307–308

See application file for complete search history.

(56) References Cited

U.S. PATENT DOCUMENTS

| | | | | |
|---|---|---|---|---|
| 5,646,464 | A | 7/1997 | Sharma et al. | |
| 2014/0016320 | A1* | 1/2014 | Shumate | F21V 5/008 362/269 |
| 2014/0077724 | A1* | 3/2014 | Sawada | H02M 3/157 315/307 |
| 2014/0247164 | A1* | 9/2014 | Lane | B64F 1/20 340/983 |
| 2015/0115809 | A1* | 4/2015 | Siessegger | H05B 33/0803 315/185 R |
| 2015/0229357 | A1 | 8/2015 | Range | |
| 2016/0029455 | A1* | 1/2016 | Aydin | H05B 33/0827 315/193 |

* cited by examiner

*Primary Examiner* — Henry Luong
(74) *Attorney, Agent, or Firm* — Baker & Hostetler LLP

(57) ABSTRACT

A lighting status signaling system including a lighting fixture having a light, a light driver connected to the light, and a monitor circuit connected to the light and to the light driver. The monitor circuit is configured to monitor a voltage level at an output of the light driver. A sensing circuit is coupled to the monitor circuit via a sensing wire independent of a power wire to the lighting fixture. A lighting controller is connected to the sensing circuit via the sensing wire and configured to determine a lighting status of the lighting fixture.

23 Claims, 4 Drawing Sheets

LIGHTING STATUS SIGNALING SYSTEM AND METHOD

FIELD OF THE DISCLOSURE

This disclosure is generally directed to a lighting system, and more particularly to a lighting status signaling system and method.

BACKGROUND

In conventional lighting fixtures, it is difficult, if not impossible, to reliably monitor an operational status of the lighting fixtures (i.e., whether a light is working properly or not). Conventionally, when a controller or a testing system interfaces with the lighting fixture, the validation process can become quite lengthy to test over full temperature and voltage ranges. The time to establish firmware set points and then conduct a full validation for a single combination of components for the lighting fixture may be substantial. Conventionally, current sensing is used to monitor the amount of current being used by the lighting fixture from the power supply. With newer very low power Light Emitting Diode (LED) lighting fixtures that need low level currents to operate, sensing a current input to the lighting fixture is difficult to decipher between a faulty light and a properly functional light of the lighting fixture over the full temperature and operating voltage range. For example, due to a non-linear forward voltage drop of the LED (if used as a light source in the lighting fixture), temperature and voltage variations will change the amount of current used from the power supply by the lighting fixture. In addition, if the light malfunctions, a known good measurement of the current will change. As new products are released, the new validation procedure would have to be repeated. This change to each configuration affects the backward compatibility of every new product. New part numbers then have to be created to track the configurations and validated firmware.

Accordingly, there is a need to address the foregoing and other problems associated with conventional lighting systems.

SUMMARY OF THE DISCLOSURE

According to an aspect of the disclosure, a lighting status signaling system including a lighting fixture having a light, a light driver connected to the light, and a monitor circuit connected to the light and to the light driver. The monitor circuit is configured to monitor a voltage level at an output of the light driver. A sensing circuit is coupled to the monitor circuit via a sensing wire independent of a power wire to the lighting fixture. A lighting controller is connected to the sensing circuit via the sensing wire and configured to determine a lighting status of the lighting fixture.

According to a further aspect of the disclosure, a lighting status signaling method for a lighting status signaling system including a lighting fixture having a light, a light driver connected to the light, a monitor circuit connected to the light and to the light driver, a sensing circuit coupled to the monitor circuit via a sensing wire independent of a power wire to the lighting fixture, a lighting controller connected to the sensing circuit is provided. The lighting status signaling method includes monitoring, at the monitor circuit, a voltage level at an output of the light driver. The lighting status signaling method includes sensing, at the sensing circuit, a binary current signal over the sensing wire based upon the voltage level. The lighting status signaling method includes providing the binary current signal from the sensing circuit to the lighting controller. The lighting status signaling method includes signaling, at a microprocessor of the lighting controller, a lighting status of the lighting fixture based upon the binary current signal, the lighting status indicating whether or not the light is malfunctioning.

According to a further aspect of the disclosure, a non-transitory computer readable medium of a lighting controller includes microprocessor executable code stored in a memory of the lighting controller for signaling a lighting status of a lighting fixture. The microprocessor executable code when executed by a microprocessor of the lighting controller causes the microprocessor to receive a binary voltage signal from a sensing circuit of a lighting status signaling system, said sensing circuit receiving a binary current signal associated with the binary voltage signal from a monitor circuit of a light driver of the lighting fixture, the binary current signal indicating an over-voltage output, an under-voltage output, and/or a no-voltage output of the light driver driving the light of the lighting fixture, process the binary voltage signal to determine the lighting status of the lighting fixture, and signal, at an output of the microprocessor, whether or not the light is malfunctioning based upon the lighting status.

Additional features, advantages, and aspects of the disclosure may be set forth or apparent from consideration of the following detailed description, drawings, and claims. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The accompanying drawings, which are included to provide a further understanding of the disclosure, are incorporated in and constitute a part of this specification, illustrate aspects of the disclosure and together with the detailed description serve to explain the principles of the disclosure. No attempt is made to show structural details of the disclosure in more detail than may be necessary for a fundamental understanding of the disclosure and the various ways in which it may be practiced, as may be understood by one of ordinary skill in the art in view of the present disclosure. In the drawings.

DETAILED DESCRIPTION OF THE DISCLOSURE

Figure 1:
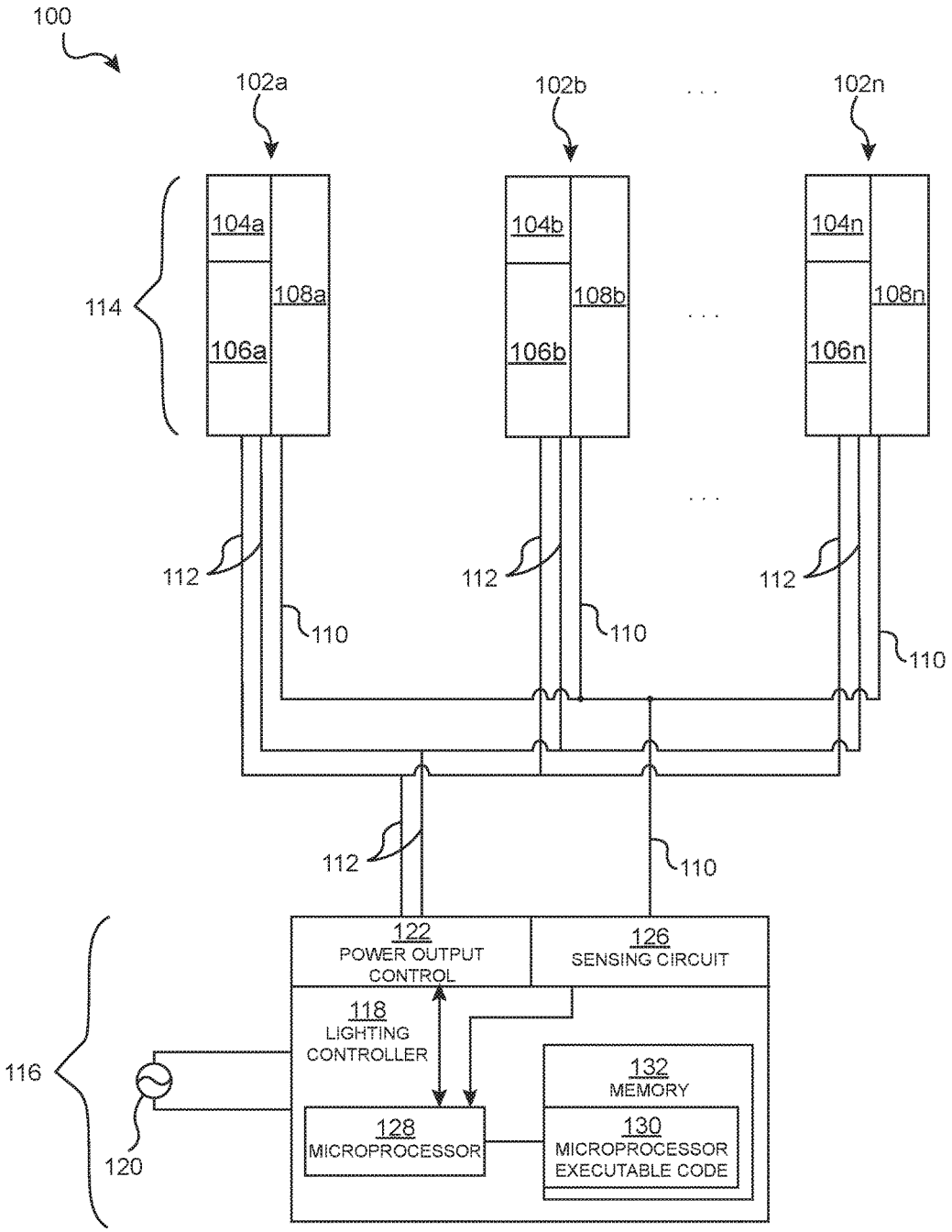
FIG. 1 illustrates an exemplary setup of a lighting status signaling system, in accordance with an aspect of the disclosure.

The aspects of the disclosure and the various features and advantageous details thereof are explained more fully with reference to the non-limiting aspects and examples that are described and/or illustrated in the accompanying drawings and detailed in the following description. It should be noted that the features illustrated in the drawings are not necessarily drawn to scale, and features of one aspect may be employed with other aspects as the skilled artisan would recognize, even if not explicitly stated herein. Descriptions of well-known components and processing techniques may be omitted so as to not unnecessarily obscure the aspects of the disclosure. The examples used herein are intended merely to facilitate an understanding of ways in which the disclosure may be practiced and to further enable those of skill in the art to practice the aspects of the disclosure. Accordingly, the examples and aspects herein should not be construed as limiting the scope of the disclosure, which is defined solely by the appended claims and applicable law. Moreover, it is noted that like reference numerals represent similar parts throughout the several views of the drawings. The present disclosure may use designations such as "first," "second," "third," "fourth," "fifth," "sixth," "additional" etc., for various components. However, it may be understood by one of ordinary skill in the art that such designations are for the sole purpose of distinguishing between different components, and are not meant to indicate any priority, order, or particular importance to the component name following a particular designation.

FIG. 1 illustrates a lighting status signaling system 100, in accordance with an aspect of this disclosure. The lighting status signaling system 100 includes a plurality of lighting fixtures 102*a*, 102*b*, . . . , 102*n*. Although FIG. 1 illustrates three of the plurality of lighting fixtures 102*a*, 102*b*, . . . , 102*n*, the plurality of lighting fixtures 102*a*, 102*b*, . . . , 102*n* may include only one, at least one, at least two, or other numbers of the lighting fixtures 102*a*, 102*b*, . . . , 102*n*. By way of example only and not by way of limitation, the plurality of lighting fixtures 102*a*, 102*b*, . . . , 102*n* may include L-810 obstruction lights, provided by Flash Technology of Franklin, Tenn., used in an obstruction lighting system for air traffic control, e.g., on or near a runway. The plurality of lighting fixtures 102*a*, 102*b*, . . . , 102*n* may each be installed in a facility such as tower structure on ground/Earth, on top of another structure such as a building, an antenna tower, a power transmission tower, a bridge, a construction crane, or the like. In one aspect, each of the plurality of lighting fixtures 102*a*, 102*b*, . . . , 102*n* may be implemented as an obstruction light, a marker light, and/or a beacon light.

The lighting status signaling system 100 may include a lighting controller 118 coupled to each of the plurality of lighting fixtures 102*a*, 102*b*, . . . , 102*n*. In the aspect shown in FIG. 1, the lighting controller 118 is coupled to the plurality of lighting fixtures 102*a*, 102*b*, . . . , 102*n* via power wires 112 and via a sensing wire 110. The lighting controller 118 may be located for easy access of operating personnel and may be thousands of feet from the plurality of lighting fixtures 102*a*, 102*b*, . . . , 102*n*.

The power wires 112 may be a pair of wires providing power to the plurality of lighting fixtures 102*a*, 102*b*, . . . , 102*n* from a mains power supply 120 or from other types of power sources known to one of ordinary skill in the art. The pair of wires of the power wires 112 may include a positive wire and a negative wire, although a three-wire connection with an additional wire for grounding may be used. The mains power supply 120 may be an alternating current (AC) or a direct current (DC) power source. Additionally or optionally, each of the plurality of lighting fixtures 102*a*, 102*b*, . . . , 102*n* may have an independent source of power (e.g., a battery, a generator, etc.) that can act as an additional power source or as a power source when there is a disruption in the mains power supply 120.

The sensing wire 110 may be a wire configured to carry one or more current signals associated with each of the plurality of lighting fixtures 102*a*, 102*b*, . . . , 102*n* to the lighting controller 118, as discussed with respect to FIGS. 2-5. The one or more current signals carry information to the lighting controller 118 indicating whether or not each of the respective ones of the plurality of lighting fixtures 102*a*, 102*b*, . . . , 102*n* are functioning properly. The sensing wire 110 may be placed along respective structures on which the plurality of lighting fixtures 102*a*, 102*b*, . . . , 102*n* are placed running from a top portion 114 to a base portion 116 of the structure. In an alternative aspect, the sensing wire 110 may carry additional information, such as identifiers for each of the plurality of lighting fixtures 102*a*, 102*b*, . . . , 102*n*, and the like. Still alternatively, the sensing wire 110 may be in addition to a wireless transceiver acting as another source of information (not shown) attached to each of the plurality of lighting fixtures 102*a*, 102*b*, . . . , 102*n* to wirelessly communicate with the lighting controller 118 regarding an operational status of each of the plurality of lighting fixtures 102*a*, 102*b*, . . . , 102*n*. However, as will be understood by one of ordinary skill in the art in view of this disclosure, such a wireless transceiver cannot provide information in the form of a stable current signal, such as that provided on the sensing wire 110. By way of example only and not by way of limitation, the sensing wire 110 may be a gauge 18 thickness communication wire, although other types of wires suitable for carrying current signals may be used.

Further, although FIG. 1 illustrates the sensing wire 110 and the power wires 112 being common to all of the plurality of lighting fixtures 102*a*, 102*b*, . . . , 102*n*, such an illustration is by way of example only and not by way of limitation, as each of the plurality of lighting fixtures 102*a*, 102*b*, . . . , 102*n* may include the sensing wire 110 and the power wires 112 for independent coupling/connection to the lighting controller 118. However, such independent coupling with each of the plurality of lighting fixtures 102*a*, 102*b*, . . . , 102*n* having a unique one of the sensing wire 110 and the power wires 112 may increase the wiring complexity and costs of the lighting status signaling system 100. In one aspect, the sensing wire 110 is independent of the power wires 112 and is physically placed separate from the power wires 112 on each of the plurality of lighting fixtures 102*a*, 102*b*, . . . , 102*n*. In this respect, the sensing wire 110, independent of a working of the power wires 112, is communicably coupled or connected to provide an independent communication pathway with the lighting controller 118.

Each of the plurality of lighting fixtures 102*a*, 102*b*, . . . , 102*n* includes lights 104*a*, 104*b*, . . . , 104*n*, respectively, light drivers 106*a*, 106*b*, . . . , 106*n*, respectively, and monitor circuits 108*a*, 108*b*, . . . , 108*n*, respectively. By way of example only and not by way of limitation, the lights 104*a*, 104*b*, . . . , 104*n* may be light emitting diodes (LEDs) used, for example, in an obstruction light, a marker light, and/or a beacon light collectively referred to herein as an obstruction light. Further by way of example only and not by way of limitation, each of the lights 104*a*, 104*b*, . . . , 104*n* may include 3-6 LEDs, or bulbs, or lamps, etc. An output of the lights 104*a*, 104*b*, . . . , 104*n* may be in the visible optical spectrum for easy viewing by a human (e.g., a pilot of an aircraft or an air traffic control officer). For example, such output may be red, white, blue, green, or other types of visible light either at a constant level or at varying at periodic intervals. In one aspect, the output may alternatively or additionally be infrared that can be detected by night vision goggles.

Each of the lights 104*a*, 104*b*, . . . , 104*n* is powered or driven by the light drivers 106*a*, 106*b*, . . . , 106*n*, respectively. The light drivers 106*a*, 106*b*, . . . , 106*n* are arranged to receive input power from the power wires 112 and convert the input power to an output current and output voltage input to the lights 104*a*, 104*b*, . . . , 104*n*, respectively. For example, each of the light drivers 106*a*, 106*b*, . . . , 106*n* may be a constant current output driver for LEDs 202 (illustrated in FIG. 2). A voltage level 210 (shown in FIG. 2) at an output of the light drivers 106*a*, 106*b*, . . . , 106*n* may depend upon specific electrical requirements of the lights 104*a*, 104*b*, . . . , 104*n*, as will be understood by one of ordinary skill in the art. For example, the voltage level 210 at the output of the light drivers 106*a*, 106*b*, . . . , 106*n* will vary depending on whether the lights 104*a*, 104*b*, . . . , 104*n*, are LEDs, incandescent lights, halogen lamps, and the like.

Ideally, the voltage level 210 and a current level (not shown) at the outputs of the light drivers 106*a*, 106*b*, . . . , 106*n* should be stable, if not constant, for proper operation of the lights 104*a*, 104*b*, . . . , 104*n*. However, for various reasons, as discussed herein, the voltage level 210 and the current level at the outputs of the light drivers 106*a*, 106*b*, . . . , 106*n* may fluctuate. The reasons for such fluctuations may include, but are not limited to, non-linearities inherent to the lights 104*a*, 104*b*, . . . , 104*n*, temperature variations, electrical interferences, power outages, power surges during inclement weather or lightning, and the like, or combinations thereof. Such fluctuations may affect the output of the lights 104*a*, 104*b*, . . . , 104*n* and/or may cause one or more of the lights 104*a*, 104*b*, . . . , 104*n* to malfunction, fail or the like. For example, one or more of the LEDs 202 of the light 104*a* may fail (e.g., via a p-n junction breakdown). Such variations or malfunctioning of the lights 104*a*, 104*b*, . . . , 104*n* may be undesirable, for example, in aviation scenarios where aviation authorities may require predictable and stable functioning of the lights 104*a*, 104*b*, . . . , 104*n*. Further, any malfunctioning of the lights 104*a*, 104*b*, . . . , 104*n* needs to be reported to the authorities within a stipulated time frame. Failure to report and/or fix a failing lighting fixture (e.g., the lighting fixture 102*a*), and hence a provider thereof, may be deemed non-compliant with the rules and regulations. Accordingly, there is a need to efficiently and accurately determine an operational status or a lighting status of the lights 104*a*, 104*b*, . . . , 104*n*. Generally, the term "operational status" or "lighting status" refers to whether or not the lights 104*a*, 104*b*, . . . , 104*n* of the plurality of lighting fixtures 102*a*, 102*b*, . . . , 102*n*, respectively, are performing according to a preset threshold performance, whether one or more of the lights 104*a*, 104*b*, . . . , 104*n* are out or are malfunctioning, or whether the lights 104*a*, 104*b*, . . . , 104*n* have an output that causes one or more of the plurality of lighting fixtures 102*a*, 102*b*, . . . , 102*n* to be out of compliance with regulatory authorities, and the like or combinations thereof.

To at least address the foregoing issues, the monitor circuits 108*a*, 108*b*, . . . , 108*n* are connected to the lights 104*a*, 104*b*, . . . , 104*n* and the light drivers 106*a*, 106*b*, . . . , 106*n*, respectively. The monitor circuits 108*a*, 108*b*, . . . , 108*n* are discussed in further detail with respect to FIG. 2, using the monitor circuit 108*a* as a representative example.

In one aspect of this disclosure, the lighting controller 118 may include a power output control 122, a sensing circuit 126, a microprocessor 128, and a memory 132 having microprocessor executable code 130 stored thereupon. The power output control 122 includes control circuitry to condition electrical power received from the mains power supply 120 and provides the conditioned electrical power to the power wires 112. For example, depending upon a type of the lights 104*a*, 104*b*, . . . , 104*n*, a particular level of power may be delivered to the light drivers 106*a*, 106*b*, . . . , 106*n*, respectively. The power output control 122 may step-up or step down the level of the power provided to the power wires 112 depending upon the particular level required by the lights 104*a*, 104*b*, . . . , 104*n*. The power output control 122 may also generate a direct current in some aspects.

The sensing circuit 126 is coupled to the sensing wire 110 and receives an output 202 from the monitor circuits 108*a*, 108*b*, . . . , 108*n*. The sensing circuit 126 is coupled to the microprocessor 128 in the lighting controller 118. Additionally, although not illustrated, the sensing circuit 126 may receive power from the mains power supply 120.

The microprocessor 128 may include a global navigation satellite system (GNSS) processor, an antenna signal processor for communication over a communication channel as defined herein, an Ethernet connector for communication over a communication channel as defined herein, on-chip memory, synchronization circuitry, amplifiers, filters, and other signal processing circuitry, buses (e.g., $I^2C$ buses), address registers for addressing various components of the lighting controller 118, RS-232 connectors for communications, modulators, demodulators, and the like. Functionalities of one or more components of the microprocessor 128 may, at least partially, exist outside the microprocessor 128, for example, on a programmable logic array (PLA) or an application specific integrated circuit (ASIC) customized to carry out the various features and functionalities associated with signaling the lighting status of the plurality of lighting fixtures 102*a*, 102*b*, . . . , 102*n* in the lighting status signaling system 100.

The memory 132 may be one or more of read-only (non-volatile) memories, random access memories, or other re-writable (volatile) memories. The memory 132 may include non-transitory computer-readable medium that acts as a tangible storage medium for files, code, and the like. Accordingly, the aspects of this disclosure are considered to include a tangible storage medium or distribution medium, and including art-recognized equivalents and successor media, in which the software implementations herein may be stored. In one aspect, the memory 132 may include microprocessor executable code 130 which when executed by the microprocessor 128 cause the microprocessor 128 to carry out various features and functionalities of the aspects of this disclosure, for example, at least parts of a lighting status signaling method 500 discussed with respect to FIG. 5. The microprocessor executable code 130 may be compiled and executed by the microprocessor 128 using high level programming languages (e.g., C) or low-level programming techniques (e.g., using Op-codes for Assembly language), or both, and the like.

The lighting controller 118 may be relatively positioned at a level/height lower than the lights 104*a*, 104*b*, . . . , 104*n*, the light drivers 106*a*, 106*b*, . . . , 106*n*, and the monitor circuits 108*a*, 108*b*, . . . , 108*n*. For example, when the plurality of lighting fixtures 102*a*, 102*b*, . . . , 102*n* are each in a facility, the lighting controller 118 may be at the base portion 116 of the facility at a height lower than the top portion 114 of the facility including plurality of lighting fixtures 102*a*, 102*b*, . . . , 102*n*, respectively. Alternatively, the lighting controller 118 and the plurality of lighting fixtures 102*a*, 102*b*, . . . , 102*n* may be relatively positioned at equal or substantially equal heights from the ground. In one aspect, each of the plurality of lighting fixtures 102*a*, 102*b*, . . . , 102*n* may be implemented as an obstruction light, a marker light, and/or beacon light.

Figure 2:
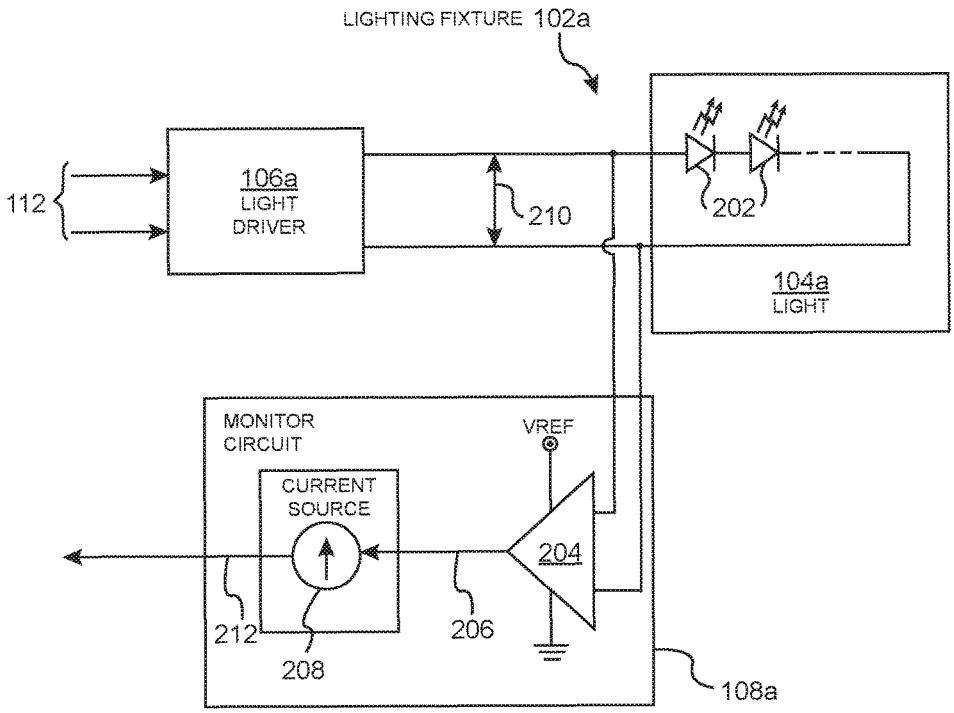
FIG. 2 illustrates an example lighting fixture of the lighting status signaling system of FIG. 1, in accordance with an aspect of the disclosure.

Referring to FIG. 2, an arrangement and connections of the light driver 106*a*, the light 104*a*, and the monitor circuit 108*a* of the lighting fixture 102*a* are exemplarily illustrated, in accordance with an aspect of this disclosure. The light driver 106*a* may be arranged to receive a power input (e.g., DC power) from the power wires 112. The voltage level 210 and a current level (not shown) is present at an output of the light driver 106*a*. The voltage level 210 may fluctuate for various reasons, including but not limited to, power outages, thermal variations, non-linearities in the light 104*a* or elsewhere in the lighting fixture 102*a*, lightning or other weather events, and the like, or combinations thereof. In one aspect, the light driver 106*a* may include circuitry for implementing AC to DC conversion, step-down transformer, and the like, as known to one of ordinary skill in the art. In the absence of fluctuations, the output of the light driver 106*a* may be substantially stable DC current and voltage. Alternatively, the light driver 104*a* may output AC current and voltage. The output of the light driver 106*a* is provided to the light 104*a*, which in turn provides an optical output.

In the example illustrated in FIG. 2, the light 104*a* may include a plurality of the LEDs 202. In one aspect, the light 104*a* may include 3-6 of the LEDs 202 with a predetermined output illuminance. Alternatively, the light 104*a* may include other types of visible spectrum optical sources including but not limited to halogen lamps, incandescent lamps, fluorescent lamps, and the like or combinations thereof. By way of example only, the light 104*a* may be a VANGUARD™ LED series light source provided by Flash Technology of Franklin, Tenn. The light 104*a* may be designed to have performance specifications in compliance with aviation authorities such as the Federal Aviation Authority (FAA) in the United States. Various operational parameters for such FAA compliant lighting systems are known to one of ordinary skill in the art and will not be described herein. For example, such parameters may include telemetric data pertaining to flash intensity (day/night), flash rate (day/night), power consumption, power output, luminosity, temperature (ambient as well as that of the light 104*a*), voltage, current, the LEDs 202 when out, run time, etc.

In accordance with an aspect of this disclosure, the monitor circuit 108*a* is connected in between the light driver 106*a* and the light 104*a*. The monitor circuit 108*a* is arranged in a parallel connection with the series connection of the light driver 106*a* and the light 104*a* to monitor the voltage level 210. As discussed herein, the voltage level 210 at the output of the light driver 106*a* (or, at an input of the light 104*a*) is used to determine an over-voltage output, an under-voltage output, or a no-voltage output. An over-voltage output may occur, for example, when one or more of the LEDs 202 is open circuit and/or has failed. Likewise, an under-voltage output may occur when one or more of the LEDs 202 is shorted or the series string formed by the LEDs 202 has been bypassed to a point of non-conformance with the regulations for the plurality of lighting fixtures 102*a*, 102*b*, . . . , 102*n*.

Figure 4:
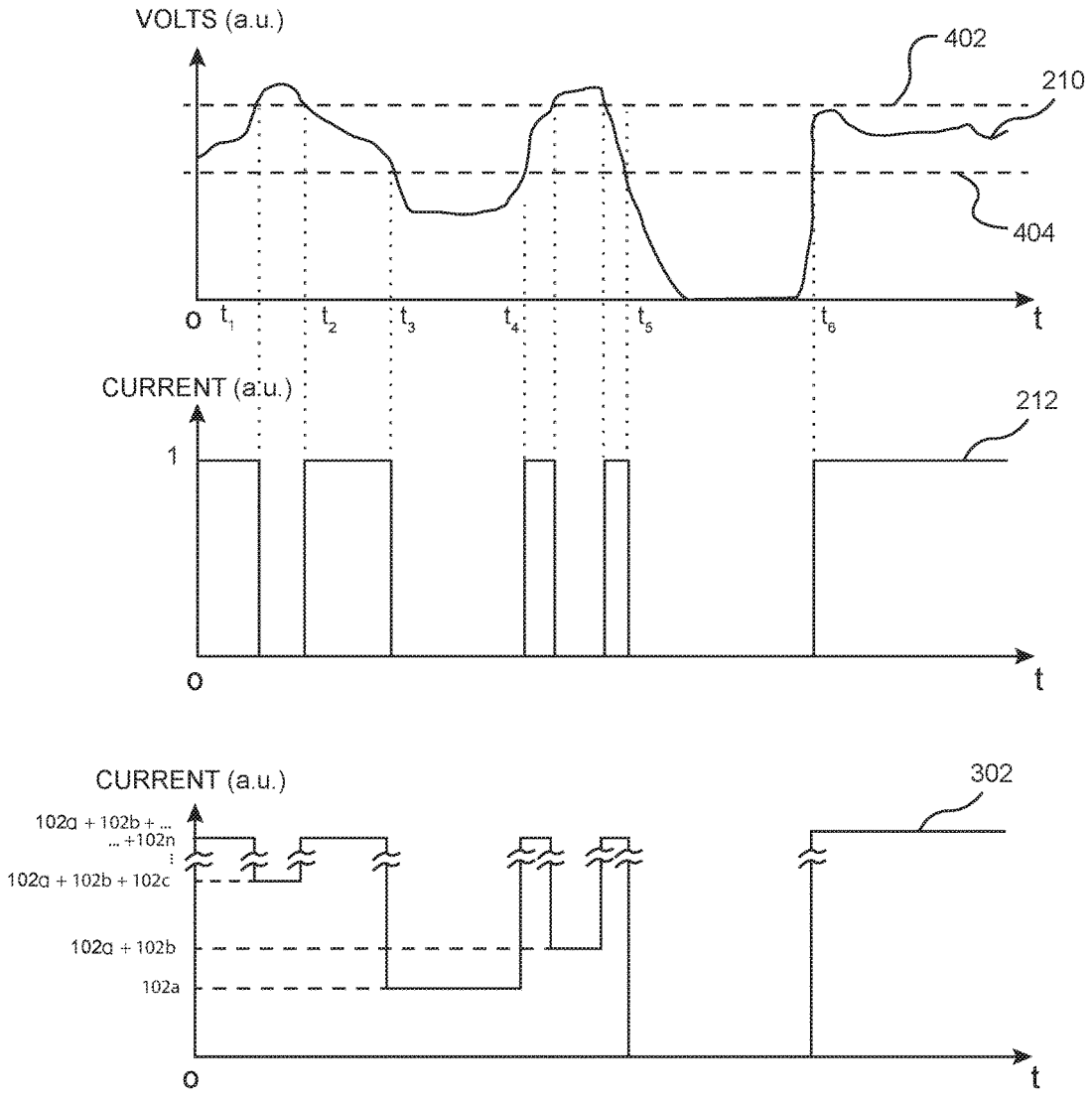
FIG. 4 illustrates exemplary plots of voltages and currents in the lighting status signaling system of FIG. 1, in accordance with an aspect of the disclosure.

Under normal conditions, the voltage level 210 is within a range of values indicated by an over-voltage threshold 402 and an under-voltage threshold 404 in FIG. 4. Within this range, the voltage level 210 is deemed as stable by the lighting controller 118 and the light 104*a* has a more or less stable optical output. When the voltage level 210 falls below the under-voltage threshold 404 (e.g., during a time period $t_3$-$t_4$), the light driver 106*a* is said to have an under-voltage output. Likewise, when the voltage level 210 is above the over-voltage threshold 402 (e.g., during a time period $t_1$-$t_2$), the light driver 106*a* is said to have an over-voltage output. Further, when the voltage level 210 falls to a zero-voltage threshold (e.g., partly during a time period $t_5$-$t_6$), the light driver 106*a* is said to have a no-voltage output. In view of this disclosure, one of ordinary skill in the art will appreciate that actual numerical values of the over-voltage threshold 402, the under-voltage threshold 404, as well as the zero-voltage threshold will depend upon a type of the LEDs 202, specific applications and compliance requirements which the plurality of lighting fixtures 102*a*, 102*b*, . . . , 102*n* are implemented for. By way of example only and not by way of limitation, for air traffic control operations, the over-voltage threshold 402 may be above 100V, the under-voltage threshold 404 may be below 12V, an the zero-voltage threshold may be at or around 0V-1V (e.g., 500 mV).

In an alternative aspect, the over-voltage threshold 402 and the under-voltage threshold 404 may be identical. In this aspect, the light driver 106*a* has an over-voltage output when the voltage level 210 is above the identical value for the over-voltage threshold 402 and the under-voltage threshold 404. Likewise, the light driver 106*a* has an under-voltage output when the voltage level 210 is below the identical value for the over-voltage threshold 402 and the under-voltage threshold 404. The no-voltage output remains the same being equal to a zero-voltage threshold from the light driver 106*a*.

In one aspect, the monitor circuit 108*a* is constructed to include a comparator 204 parallely coupled or connected to the output of the light driver 106*a* such that the voltage level 210 is provided as a differential input to the comparator 204. The comparator 204 may be implemented using an operational amplifier (OPAMP) as a window comparator operating in a comparison window of the under-voltage threshold 404 and the over-voltage threshold 402, although the comparator 204 may be implemented using other differential or non-differential techniques, as will be understood by one of ordinary skill in the art reading this disclosure. The comparator 204 may be programmed to include a reference voltage $V_{REF}$ for each of the over-voltage threshold 402, the under-voltage threshold 404, and the zero-voltage threshold. Such programming of the comparator 204 may be carried out in real time by the microprocessor 128 of the lighting controller 118. Alternatively, the comparator 204 may be programmed for $V_{REF}$ prior to installation on the lighting fixture 102*a*. In one aspect, the comparator 204 may also include a ground terminal.

By way of example only, when the light 104*a* uses the LEDs 202, a semiconductor p-n junction diode making each of the LEDs 202 is typically made from an indium gallium arsenide (InGaAs) alloy, which emits light when a voltage is applied across terminals of the p-n junction diode. The electro-luminance (measured in lux) can be controlled by changes in a current through each of the LEDs 202. By using the light driver 106*a* as a constant current power supply driver for the LEDs 202 in a series string, the light output can be set to a specific level. Due to this constant current output from the light driver 106*a*, if the voltage level 210 output by the light driver 106*a* should fluctuate or be changed to a different nominal input voltage, the input current to the light 104*a* will also change to match the power needed to supply the correct constant current output. Another large contributor to input current variation is the effect of temperature on the forward voltage drop of the LEDs 202. This forward voltage drop is not a linear function of input power to the LEDs 202 and requires extensive testing to verify the effects and to compensate for the change in the voltage level 210, which will in turn affect the input current being used by the light 104*a*.

The monitor circuit 108*a* addresses these variations in the voltage level 210 by monitoring the operational status of the light 104*a* (e.g., at an input thereof) and outputting a temperature and voltage stable current signal used in a current loop configuration using the sensing wire 110. The comparator 204 is coupled to a current source 208 to implement such a current loop configuration connecting the monitor circuit 108*a* to the lighting controller 118 via the sensing wire 110. This current loop is easily monitored and less susceptible to noise and poor connections that would interfere with a voltage signaling circuit, if such a voltage signaling circuit were used instead. The current source 208 may be an active or a passive current source and may be a controlled current source implemented using field effect transistors (FETs) or current limiting diodes powered, for example, by the power wires 112.

In one aspect, based upon whether the voltage level 210 goes above the over-voltage threshold 402, stays within the range bound by the over-voltage threshold 402 and the under-voltage threshold 404, falls below the under-voltage threshold 404, or falls down to the zero-voltage threshold, the comparator 204 outputs an enable signal 206 to the current source 208. As shown in FIG. 4, the enable signal 206 causes the current source 208 to output a binary current signal 212 on the sensing wire 110 having a value equivalent to a binary '1'. When the voltage level 210 stays within a voltage value between the over-voltage threshold 402 and the under-voltage threshold 404, the comparator 204 may output the enable signal 206 to turn on the current source 208, which then outputs a binary '1'. When disabled, the binary current signal 212 output by the current source 208 may have a value equivalent to the binary value '0', or the binary current signal 212 may be turned off or not exist when the current source 208 is disabled, which happens when the voltage level 210 is above the over-voltage threshold 402 or below the under-voltage threshold 404, or is zero. In one aspect, the current source 208 may be disabled for additional reasons, including but not limited to, a low quality factor of power supplied to the power wires 112 or a power loss at the mains power supply 120.

A waveform corresponding to the binary current signal 212 indicated as having a level between a binary '1' and a binary '0' (in arbitrary units (a.u.)) is illustrated in FIG. 4, with a '1' indicating that one or more of the LEDs 202 of the light 104*a* are receiving an acceptable power input, and therefore have an optical output that is acceptable (not erroneous or not unstable). As a result, the operational status or the lighting status of the light 104*a* is deemed as acceptable and in compliance with the regulations.

Alternatively, one of ordinary skill in the art reading this disclosure will understand that a different logic scheme may instead be implemented by the comparator 204 and the current source 208 where, when the voltage level 210 goes above the over-voltage threshold 402, falls below the under-voltage threshold 404, or falls down to the zero-voltage threshold, the comparator 204 may output the enable signal 206 to the current source 208. As a result, in such a logic scheme, the current source 208 may output the binary current signal 212 or may output a value of the binary current signal 212 equivalent to a binary '1'. Likewise, the current source 208 may be disabled when the voltage level 210 stays within a voltage value between the over-voltage threshold 402 and the under-voltage threshold 404 to indicate that the light 104*a* is receiving acceptable input and has an acceptable operational or lighting status.

Figure 3:
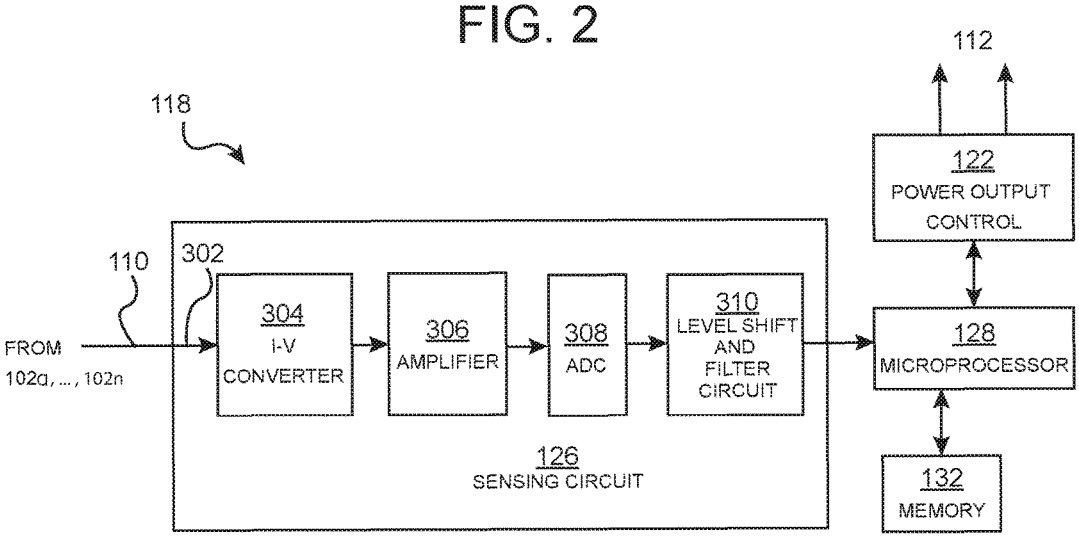
FIG. 3 illustrates an example structure of a lighting controller of the lighting status signaling system of FIG. 1, in accordance with an aspect of the disclosure.

Referring to FIGS. 3 and 4, each of the plurality of lighting fixtures 102*a*, 102*b*, . . . , 102*n* has an output of binary current signals (similar to the binary current signal 212 on the sensing wire 110 from respective ones of the monitor circuits 108*a*, 108*b*, . . . , 108*n*. Since current is an additive physical phenomenon, the sensing circuit 126 receives an additive current signal 302 (illustrated in FIG. 4). The additive current signal 302 is a sum of the binary current signals (including the binary current signal 212) from respective ones of the monitor circuits 108*a*, 108*b*, . . . , 108*n*. The additive current signal 302, as illustrated in FIG. 4, gives a clear linear indication of whether one or more of the lights 104*a*, 104*b*, . . . , 104*n* are malfunctioning. For example, if the binary current signal 212 has a value 1A (DC) corresponding to one of the lights 104*a*, 104*b*, . . . , 104*n* functioning properly, and when all the lights 104*a*, 104*b*, . . . , 104*n* are functioning properly, the additive current signal 302 has a value equal to n times 1A (DC). If one of the lights 104*a*, 104*b*, . . . , 104*n* is malfunctioning, the additive current signal 302 has a value equal to n−1 times 1A (DC), and so on for each of the lights 104*a*, 104*b*, . . . , 104*n* that may be malfunctioning or are out. Alternatively, the binary current signal 212 may be an alternating current (AC) signal, or may be superimposed upon an AC signal carrier. An exemplary advantage of using the additive current signal 302, or for that matter, the binary current signal 212, as opposed to a voltage signal, is a robustness of current signal in the presence of high electromagnetic interference (EMI) and other radio frequency (RF) signals typically found where the plurality of lighting fixtures 102*a*, 102*b*, . . . , 102*n* may be installed (e.g., in an obstruction lighting environment). In addition, the additive current signal 302, as well as the binary current signal 212, is less affected by poor installation, bad electrical connections and splicing that may accidentally occur during installation or operation of the lighting status signaling system 100.

Referring to FIG. 3, the additive current signal 302 is received by the sensing circuit 126 at a current-to-voltage (I-V) converter 304. The I-V converter 304 is configured to convert the additive current signal 302 to an equivalent voltage signal. The I-V converter 304 may be implemented using an operational amplifier operating with a predetermined I-V gain, according to electrical specifications of the lighting status signaling system 100, as will be understood by one of ordinary skill in the art reading this disclosure. The I-V converter 304 is connected to an amplifier 306.

The amplifier 306 is configured to amplify the voltage signal equivalent to the additive current signal 302. By way of example only and not by way of limitation, the amplifier 306 may be a low noise amplifier that accounts for signal degradation faced by the additive current signal 302 in view of external interference and different types of noise as the additive current signal 302 travels along the sensing wire 110. The amplifier 306 is connected to an analog to digital converter (ADC) 308.

The ADC 308 is an m-bit ADC, where the index 'm' may be a power of 2 (e.g., m=8). The amplified voltage output at the amplifier 306 is converted to a binary sequence at the ADC 308, for processing by the microprocessor 128 as a digital signal. The ADC 308 may convert the amplified voltage output at the amplifier 306 by a quantization of the amplified voltage output. Further, instead of continuously performing the conversion, the ADC 308 does the conversion periodically, sampling the amplified voltage output from the amplifier 306. An output of the ADC 308 is a sequence of digital values that have been converted from a continuous-time and continuous-amplitude signal to a discrete-time and discrete-amplitude digital signal.

The level shift and filter circuit 310 is configured to adapt a level of the digital output from the ADC 308 for the microprocessor 128 and filter any noise in the digital signal. For example, the level shift and filter circuit 310 may perform level shifting of the output from the ADC 308 between RS-232 logic levels and TTL-level signals, followed by digital filtering. In one aspect, the level shift and filter circuit 310 may be two separate circuits, one for level shifting and one for filtering. Alternatively, the level shifting and filtering functionalities may be combined into a single integrated circuit chip. The level shift and filter circuit 310 may be connected to an input port of the microprocessor 128.

The microprocessor 128 may then analyze the digital signal to identify the operational status of the lights 104*a*, 104*b*, . . . , 104*n* and output a corresponding signal for the operational status. For example, the microprocessor 128 may output an audio, a visual, an audio-visual alarm signal indicating to a technician that one or more of the lights 104*a*, 104*b*, . . . , 104*n* are out or are not performing in compliance. In one aspect, the microprocessor 128 may output a signal on a communication channel as defined herein to a server monitoring the lights 104*a*, 104*b*, . . . , 104*n*.

It will be appreciated by one of ordinary skill in the art that the sensing circuit 126 may include additional components (e.g., binary level sensors, analog filters), in addition to the I-V converter 304, the amplifier 306, the ADC 308, and the level shift and filter circuit 310. Alternatively, the sensing circuit 126 may include fewer components that those shown in FIG. 3, in which case one or more of the components may be implemented using the microprocessor 128 or other programmable logic units.

Figure 5:
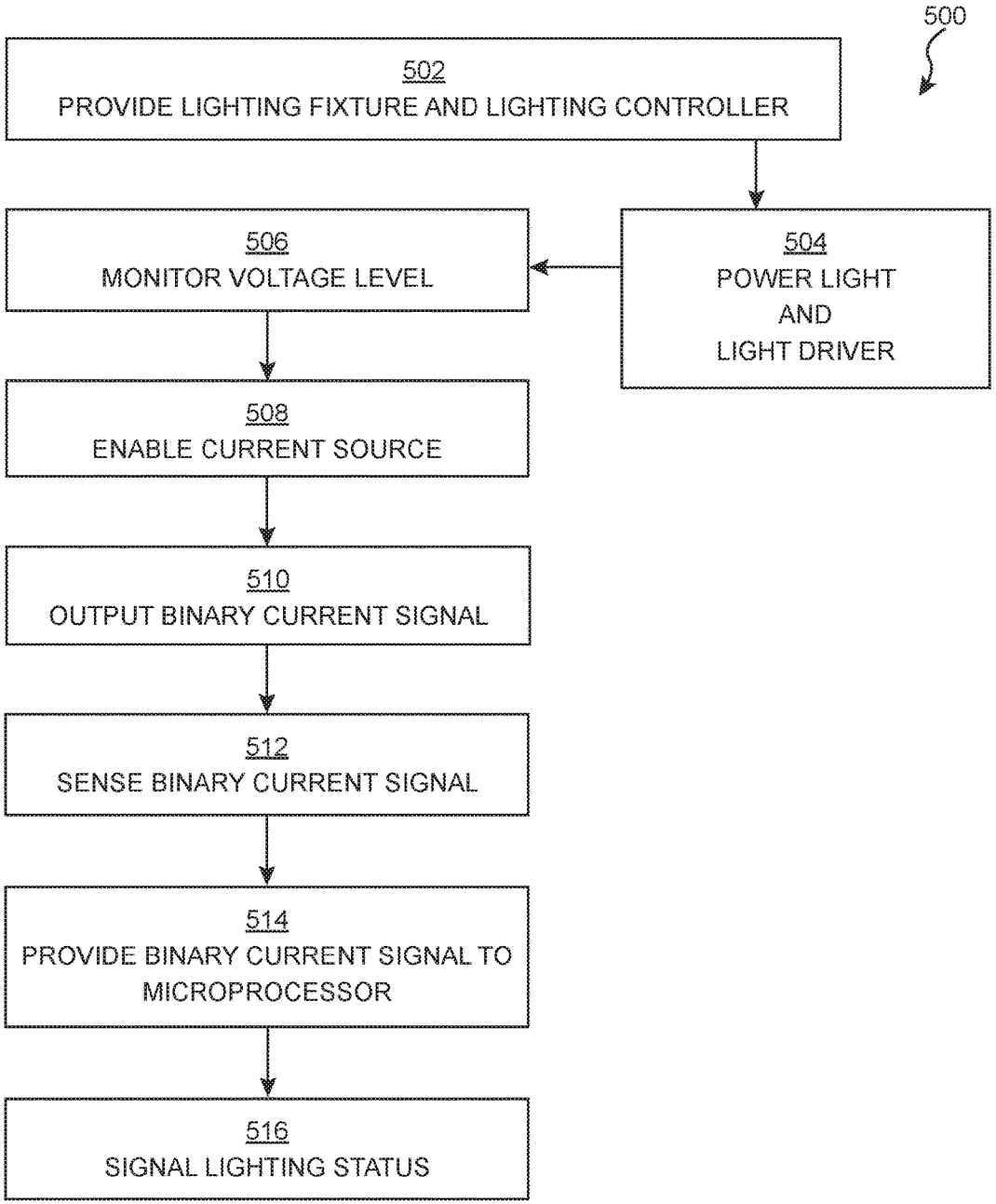
FIG. 5 illustrates a lighting status signaling method for the lighting status signaling system of FIG. 1, in accordance with an aspect of the disclosure.

FIG. 5 illustrates a flowchart of the lighting status signaling method 500 for the lighting status signaling system 100 including the plurality of lighting fixtures 102*a*, 102*b*, . . . , 102*n* and the lighting controller 118 connected via the power wires 112 and the sensing wire 110, in accordance with an aspect of the disclosure. The lighting status signaling method 500 may be provided by way of example only, to manufacture, make, arrange, implement, assemble, and/or operate the lighting status signaling system 100, as there are a variety of ways to manufacture, make, arrange, implement, assemble, and/or operate the lighting status signaling system 100. The lighting status signaling method 500 shown in FIG. 5 can be executed or otherwise performed by one or a combination of various systems. Each block shown in FIG. 5 represents one or more processes, methods or subroutines carried out exemplary by the lighting status signaling method 500.

In one aspect, one or more processes or operations in the lighting status signaling method 500 may be carried out by a manufacturer of the lighting status signaling system 100 using tools and/or technicians. Further, one or more processes may be skipped or combined as a single process, repeated several times, and the flow of processes in the lighting status signaling method 500 may be in any order not limited by the specific order illustrated in FIG. 5. For example, various operations of the lighting status signaling method 500 may be moved around in terms of their respective orders, or may be carried out in parallel with one or more processes.

Referring to FIG. 5, in an operation 502, one or more of the plurality of lighting fixtures 102*a*, 102*b*, . . . , 102*n* may be provided with the lighting controller 118 being common to all of the plurality of lighting fixtures 102*a*, 102*b*, . . . , 102*n*. In the operation 502, the sensing wire 110 and the power wires 112 may be connected. The sensing wire 110 is connected independent of and separately from the power wires 112, although the sensing wire 110 may share bundling space with the power wires 112. By way of example only, the plurality of lighting fixtures 102*a*, 102*b*, . . . , 102*n* may be provided as part of an obstruction lighting system of which the lighting status signaling system 100 is a part. In one aspect, in the operation 502, the providing of the plurality of lighting fixtures 102*a*, 102*b*, . . . , 102*n* including the lights 104*a*, 104*b*, . . . , 104*n*, the light drivers 106*a*, 106*b*, . . . , 106*n*, and the monitor circuits 108*a*, 108*b*, . . . , 108*n* is carried out at the top portion 114 of a facility. Likewise, the sensing circuit 126 and the lighting controller 118 may be provided at the base portion 116 of the facility, with the sensing wire 110 running between the top portion 114 and the base portion 116 of the facility.

In an operation 504, the lights 104*a*, 104*b*, . . . , 104*n* and the light drivers 106*a*, 106*b*, . . . , 106*n* may be powered using the power wires 112. The power wires 112 may receive power from the mains power supply 120 conditioned by the lighting controller 118. In one aspect, the light drivers 106*a*, 106*b*, . . . , 106*n* may be powered using a DC voltage carried by the power wires 112 and convert the received power to a DC current at the voltage level 210 for the lights 104*a*, 104*b*, . . . , 104*n*. When powered, the lights 104*a*, 104*b*, . . . , 104*n* output optical frequencies in the visible spectrum. In one aspect, the lights 104*a*, 104*b*, . . . , 104*n* may output alternatively or additionally infrared light that can be detected by night vision goggles.

In an operation 506, the voltage level 210 at an output of the light drivers 106*a*, 106*b*, . . . , 106*n* (e.g., the light driver 106*a* shown in FIG. 2) is monitored by the monitor circuits 108*a*, 108*b*, . . . , 108*n* (e.g., by the monitor circuit 108*a* in FIG. 2). It will be appreciated that the voltage level 210 is input to the LEDs 202 of the lights 104*a*, 104*b*, . . . , 104*n*. Accordingly, references herein to monitoring the voltage level 210 at the output of the light drivers 106*a*, 106*b*, . . . , 106*n* include monitoring the input of the lights 104*a*, 104*b*, . . . , 104*n* also, as will be appreciated by one of ordinary skill in the art reading this disclosure. In one aspect, the monitoring the voltage level 210 includes detecting the over-voltage output, the under-voltage output, and/or the no-voltage output from one or more of the drivers 106*a*, 106*b*, . . . , 106*n* at the comparator 204 of the monitor circuits 108*a*, 108*b*, . . . , 108*n*, respectively.

In an operation 508, one or more of the monitor circuits 108*a*, 108*b*, . . . , 108*n* carries out enabling the current source 208, respectively, either present in each of the monitor circuits 108*a*, 108*b*, . . . , 108*n* or outside the monitor circuits 108*a*, 108*b*, . . . , 108*n*, but connected to respective outputs of the monitor circuits 108*a*, 108*b*, . . . , 108*n*. Based upon whether the voltage level 210 is monitored in the operation 506 to be above the over-voltage threshold 402, falls below the under-voltage threshold 404, or falls down to the zero-voltage threshold, the comparator 204 outputs an enable signal 206 to the current source 208, as discussed with respect to FIG. 4.

In an operation 510, the enable signal 206 causes the current source 208 to carry out outputting the binary current signal 212 on the sensing wire 110, based upon the enabling, a value equivalent to a binary '1'. When the voltage level 210 stays within a voltage value between the over-voltage threshold 402 and the under-voltage threshold 404, the comparator 204 may turn off the enable signal 206 to disable the current source 208. When disabled, the binary current signal 212 output by the current source 208 may have a value equivalent to the binary value '0', or the binary current signal 212 may be turned off or not exist when the current source 208 is disabled. In one aspect, the current source 208 may be disabled for additional reasons, including but not limited to, a low quality factor of power supplied to the power wires 112 or a power loss at the mains power supply 120. Alternatively, a logic scheme corresponding to the binary current signal 212 shown in FIG. 4 may be applied where a binary '1' indicates that the voltage level 210 is within an acceptable range and a binary '0' indicates that the voltage level 210 is an under-voltage, an over-voltage, or a zero voltage output from the light driver 106*a*.

In an operation 512, sensing, at the sensing circuit 126, the binary current signal 212 over the sensing wire 110 based upon the voltage level 210 is carried out. In one aspect, the sensing the binary current signal 212 includes sensing the additive current signal 302 and is carried out based upon the outputting of the binary current signal 212 by the current source 208 over the sensing wire 110. Such sensing may include sensing, in the additive current signal 302, at least one additional binary current signal from an additional monitor circuit (e.g., the monitor circuit 108*b*) of an additional light (e.g., the light 104*b*) and an additional maker light driver (e.g., the light driver 106*b*). The sensing circuit 126 may then sense the additive current signal 302 which is a sum of the individual binary current signals output by the current sources (including the current source 208) of each of the monitor circuits 108*a*, 108*b*, . . . , 108*n*. The sensing by the sensing circuit 126 includes converting, at the current to voltage (I-V) converter 304 of the sensing circuit 126, the additive current signal 302 including the binary current signal 212 into a voltage signal. The sensing may include amplifying, at the amplifier 306 of the sensing circuit 126, the voltage signal. The sensing may include converting the amplified voltage signal, at the analog to digital converter (ADC) 308 of the sensing circuit 126, to a digital signal. The sensing may include level shifting and filtering, at the level shift and filter circuit 310, respectively, of the sensing circuit 126, the amplified digital signal for the microprocessor 128.

In an operation 514, the binary current signal 212, included in the additive current signal 302, or independently, is provided to the microprocessor 128, as an equivalent digital voltage signal output by the level shift and filter circuit 310. The equivalent digital voltage signal may be an m-bit signal where the index 'm' is a power of 2. The microprocessor 128 carries out processing of such an m-bit signal received from the level shift and filter circuit 310 of the sensing circuit 126. For example, as illustrated in FIG. 4, the additive current signal 302 (after conversion to an equivalent voltage signal, not shown), may indicate different levels of the binary current signals for each of the plurality of lighting fixtures 102*a*, 102*b*, . . . , 102*n* at different times as a linear sum of such signals. When a level of the additive current signal 302 is below a maximum level of current (for all the lights 104*a*, 104*b*, . . . , 104*n* working properly), the microprocessor 128 may carry out processing to determine that one or more of the lights 104*a*, 104*b*, . . . , 104*n* are out or are not functioning properly.

In an operation 516, signaling, at the microprocessor 128 of the lighting controller 118, a lighting status of the one or more of the lights 104*a*, 104*b*, . . . , 104*n* is carried out. Such signaling is based upon the additive current signal 302 (including the binary current signal 212). The lighting status indicates whether or not a particular light in the lights 104*a*, 104*b*, . . . , 104*n* is malfunctioning. Such signaling may include the microprocessor 128, via the lighting controller 118, outputting an alarm signal over a wireless communication channel or over a wired communication channel (not shown). Such an alarm signal may include audio signals, visual/optical signals, or combinations thereof. In one example, the microprocessor 128 may communicate the signaling to a remote base station or server so that appropriate technicians may be dispatched to attend to the particular light that is malfunctioning or generally, to the plurality of lighting fixtures 102*a*, 102*b*, . . . , 102*n* for inspection and/or repair. The microprocessor 128 may carry out processing the digital signal output by the ADC 308 for indicating the lighting status of the lights 104*a*, 104*b*, . . . , 104*n*, for example, using the microprocessor executable code 130.

Various aspects of this disclosure may include communication channels that may be one or more types of wired or wireless electronic communications network, such as, e.g., a wired/wireless local area network (LAN), a wired/wireless personal area network (PAN), a wired/wireless home area network (HAN), a wired/wireless wide area network (WAN), a campus network, a metropolitan network, an enterprise private network, a virtual private network (VPN), an internetwork, a backbone network (BBN), a global area network (GAN), the Internet, an intranet, an extranet, an overlay network, a cellular telephone network, a Personal Communications Service (PCS), using known protocols such as the Global System for Mobile Communications (GSM), CDMA (Code-Division Multiple Access), W-CDMA (Wideband Code-Division Multiple Access), Wireless Fidelity (Wi-Fi), Bluetooth®, Long Term Evolution (LTE), EVolution-Data Optimized (EVDO) and/or the like, and/or a combination of two or more thereof.

At least some portions of the various aspects disclosed herein may be implemented in various types of computing devices, such as, e.g., a desktop computer, personal computer, a laptop/mobile computer, a personal data assistant (PDA), a mobile phone, a tablet computer, cloud computing device, and the like, with wired/wireless communications capabilities via the communication channels.

Further in accordance with various aspects of the disclosure, the methods described herein are intended for operation with dedicated hardware implementations including, but not limited to, PCs, PDAs, semiconductors, application specific integrated circuits (ASIC), programmable logic arrays, cloud computing devices, and other hardware devices constructed to implement the methods described herein.

It should also be noted that the software implementations of the aspects, or portions thereof, as described herein are optionally stored on a tangible storage medium, such as: a magnetic medium such as a disk or tape; a magneto-optical or optical medium such as a disk; or a solid state medium such as a memory card or other package that houses one or more read-only (non-volatile) memories, random access memories, or other re-writable (volatile) memories. A digital file attachment to email or other self-contained information archive or set of archives is considered a distribution medium equivalent to a tangible storage medium. Accordingly, one or more aspects of the disclosure herein are considered to include a tangible storage medium or distribution medium, as listed herein and including art-recognized equivalents and successor media, in which the software implementations herein are stored.

According to an example, the global navigation satellite system (GNSS) may include a device and/or system that may estimate its location based, at least in part, on signals received from space vehicles (SVs). In particular, such a device and/or system may obtain "pseudorange" measurements including approximations of distances between associated SVs and a navigation satellite receiver. In a particular example, such a pseudorange may be determined at a receiver that is capable of processing signals from one or more SVs as part of a Satellite Positioning System (SPS). Such an SPS may comprise, for example, a Global Positioning System (GPS), Galileo, Glonass, to name a few, or any SPS developed in the future. To determine its location, a satellite navigation receiver may obtain pseudorange measurements to three or more satellites as well as their positions at time of transmitting. Knowing the SV orbital parameters, these positions can be calculated for any point in time. A pseudorange measurement may then be determined based, at least in part, on the time a signal travels from an SV to the receiver, multiplied by the speed of light. While techniques described herein may be provided as implementations of location determination in GPS and/or Galileo types of SPS as specific illustrations according to particular examples, it should be understood that these techniques may also apply to other types of SPS, and that claimed subject matter is not limited in this respect.

Additionally, the various aspects of the disclosure may be implemented in a non-generic computer implementation. Moreover, the various aspects of the disclosure set forth herein improve the functioning of the system as is apparent from the disclosure hereof. Furthermore, the various aspects of the disclosure involve computer hardware that it specifically programmed to solve the complex problem addressed by the disclosure. Accordingly, the various aspects of the disclosure improve the functioning of the system overall in its specific implementation to perform the process set forth by the disclosure and as defined by the claims.

Aspects of the disclosure may include a server executing an instance of an application or software configured to accept requests from a client and giving responses accordingly. The server may run on any computer including dedicated computers. The computer may include at least one processing element, typically a central processing unit (CPU), and some form of memory. The processing element may carry out arithmetic and logic operations, and a sequencing and control unit may change the order of operations in response to stored information. The server may include peripheral devices that may allow information to be retrieved from an external source, and the result of operations saved and retrieved. The server may operate within a client-server architecture. The server may perform some tasks on behalf of clients. The clients may connect to the server through the network on a communication channel as defined herein. The server may use memory with error detection and correction, redundant disks, redundant power supplies and so on.

While the disclosure has been described in terms of exemplary aspects, those skilled in the art will recognize that the disclosure can be practiced with modifications in the spirit and scope of the appended claims. The examples given above are merely illustrative and are not meant to be an exhaustive list of all possible designs, aspects, applications or modifications of the disclosure.

What is claimed is:

1. A lighting status signaling system, comprising:

a lighting fixture including a light;

a light driver connected to the light;

a monitor circuit connected to the light and to the light driver, said monitor circuit configured to monitor a voltage level at an output of the light driver;

a sensing circuit coupled to the monitor circuit via a sensing wire independent of a power wire to the lighting fixture;

the monitor circuit further configured to convert the voltage level at the output of the light driver to a binary current signal and output to the sensing circuit the binary current signal as a voltage status signal based on the voltage level at the output of the light driver; and a lighting controller connected to the sensing circuit via the sensing wire and configured to determine a lighting status of the lighting fixture based on the voltage status signal obtained from the sensing circuit.

2. The lighting status signaling system of claim 1, wherein the lighting fixture includes an obstruction light having at least one light emitting diode (LED).

3. The lighting status signaling system of claim 1, wherein the monitor circuit includes a comparator configured to detect an over-voltage output, an under-voltage output, and/or a no-voltage output from the light driver, wherein the monitor circuit is configured to output the voltage status signal based on the over-voltage output, the under-voltage output, and/or the no-voltage output from the light driver, and wherein the comparator is connected between the light driver and the light.

4. The lighting status signaling system of claim 3, further comprising:

a current source connected to an output of the comparator, wherein the comparator is configured to output an enable signal to the current source based upon the over-voltage output, the under-voltage output, and/or the no-voltage output from the light driver, the current source outputting the voltage status signal as a binary current signal based upon the enable signal.

5. The lighting status signaling system of claim 4, wherein the binary current signal is provided to the sensing circuit.

6. The lighting status signaling system of claim 4, wherein the sensing wire includes at least one additional binary current signal from at least one additional monitor circuit for at least one additional light and at least one additional light driver of an at least one additional lighting fixture.

7. An obstruction lighting system comprising the lighting status signaling system of claim 1, wherein the lighting fixture is configured as an obstruction light.

8. The lighting status signaling system of claim 1, wherein the sensing circuit includes, in series:

a current to voltage (I-V) converter;

an amplifier connected to the I-V converter;

an analog to digital converter (ADC) connected to the amplifier; and a level shift and filter circuit connected to the ADC.

9. The lighting status signaling system of claim 8, wherein the level shift and filter circuit is connected to a microprocessor of the lighting controller.

10. The lighting status signaling system of claim 1, wherein the light, the light driver, and the monitor circuit are positioned at a top portion of a facility, and wherein the sensing circuit and the lighting controller are positioned at a base portion of the facility, the sensing wire running between the top portion and the base portion.

11. The lighting status signaling system of claim 1, further comprising:

a second lighting fixture including a second light;

a second light driver connected to the second light;

a second monitor circuit connected to the second light and to the second light driver, said second monitor circuit configured to monitor a voltage level at an output of the second light driver;

the second monitor circuit coupled to the sensing circuit via the sensing wire independent of a power wire to the second lighting fixture;

the second monitor circuit further configured to convert the voltage level at the output of the second light driver to a binary current signal and output to the sensing circuit the binary current signal as a voltage status signal based on the voltage level at the output of the second light driver;

the binary current signal associated with the first and second light drivers being transmitted on said sensing wire as an additive current signal; and the lighting controller connected to the sensing circuit via the sensing wire and configured to determine a lighting status of the second lighting fixture based on the voltage status signal obtained from the second sensing circuit.

12. The lighting status signaling system of claim 11, wherein the second monitor circuit includes a comparator configured to detect an over-voltage output, an under-voltage output, and/or a no-voltage output from the second light driver, wherein the second monitor circuit is configured to output the voltage status signal based on the over-voltage output, the under-voltage output, and/or the no-voltage output from the second light driver, and wherein the second monitor circuit comparator is connected between the second light driver and the second light.

13. The lighting status signaling system of claim 12, wherein the binary current signal from the second monitor circuit is provided to the sensing circuit.

14. A lighting status signaling method for a lighting status signaling system including a lighting fixture having a light, a light driver connected to the light, a monitor circuit connected to the light and to the light driver, a sensing circuit coupled to the monitor circuit via a sensing wire independent of a power wire to the lighting fixture, and a lighting controller connected to the sensing circuit, the lighting status signaling method comprising:

monitoring, at the monitor circuit, a voltage level at an output of the light driver;

converting the voltage level from the monitor circuit to a binary current signal;

outputting the binary current signal as a voltage level signal from the monitor circuit to the sensing circuit;

sensing, at the sensing circuit, the binary current signal over the sensing wire based upon the voltage level;

providing the binary current signal from the sensing circuit to the lighting controller; and signaling, at a microprocessor of the lighting controller, a lighting status of the lighting fixture based upon the binary current signal, the lighting status indicating whether or not the light is malfunctioning based on the voltage level at the output of the light driver.

15. The lighting status signaling method of claim 14, wherein the monitoring the voltage level includes detecting an over-voltage output, an under-voltage output, and/or a no-voltage output from the light driver at a comparator of the monitor circuit.

16. The lighting status signaling method of claim 14, further comprising:

enabling, using the monitor circuit, a current source based upon the voltage level monitored by the monitor circuit; and outputting, at the current source, the binary current signal based upon the enabling, wherein the sensing the binary current signal is carried out based upon the outputting of the binary current signal by the current source over the sensing wire.

17. The lighting status signaling method of claim 14, wherein the sensing includes sensing at least one additional binary current signal from an additional monitor circuit for at least one additional light and at least one additional light driver of an at least one additional lighting fixture.

18. The lighting status signaling method of claim 14, wherein the sensing includes:

converting, at a current to voltage (I-V) converter of the sensing circuit, the binary current signal into a voltage signal;

amplifying, at an amplifier of the sensing circuit, the voltage signal;

converting the voltage signal, at an analog to digital converter (ADC) of the sensing circuit, to a digital signal; and level shifting and filtering, at a level shift and filter circuit, respectively, of the sensing circuit, the digital signal.

19. The lighting status signaling method of claim 18, wherein the signaling includes processing the digital signal at the microprocessor for said indicating.

20. The lighting status signaling method of claim 14, further comprising:

providing the light, the light driver, and the monitor circuit at a top portion of a facility, and the sensing circuit and the lighting controller at a base portion of the facility, the sensing wire running between the top portion and the base portion.

21. The lighting status signaling method of claim 14, further comprising:

powering the light and the light driver using the power wire, said power wire located independent from the sensing wire.

22. The lighting status signaling method of claim 14, wherein the light is an obstruction light including at least one light emitting diode (LED).

23. A non-transitory computer readable medium of a lighting controller comprising microprocessor executable code stored in a memory of the lighting controller for signaling a lighting status of a lighting fixture, the microprocessor executable code when executed by a microprocessor of the lighting controller causes the microprocessor to:

receive a voltage status signal from a sensing circuit of a lighting status signaling system, said sensing circuit receiving the voltage status signal as a binary current signal associated with the voltage status signal from a monitor circuit of a light driver of the lighting fixture, the binary current signal being converted from a voltage level monitored by the monitor circuit, the binary current signal indicating an over-voltage output, an under-voltage output, and/or a no-voltage output of the light driver driving the light of the lighting fixture;

process the binary current signal to determine the lighting status of the lighting fixture; and signal, at an output of the microprocessor, whether or not the light is malfunctioning based upon the lighting status based on the binary current signal indicating an over-voltage output, an under-voltage output, and/or a no-voltage output of the light driver driving the light of the lighting fixture.

* * * * *